US006732726B2

(12) United States Patent
Ho

(10) Patent No.: US 6,732,726 B2
(45) Date of Patent: May 11, 2004

(54) PAINT BALL GUN HAVING A FRONT MOUNTED GAS CYLINDER

(75) Inventor: Stephen Ho, Sugarland, TX (US)

(73) Assignee: Avalon Manufacturing Company, Houston, TX (US)

( * ) Notice: Subject to any disclaimer, the term of this patent is extended or adjusted under 35 U.S.C. 154(b) by 0 days.

(21) Appl. No.: 10/229,917

(22) Filed: Aug. 28, 2002

(65) Prior Publication Data

US 2004/0040552 A1 Mar. 4, 2004

(51) Int. Cl.[7] ..... F41B 11/06; F41B 11/26

(52) U.S. Cl. ..... 124/74; 124/56

(58) Field of Search ..... 124/74, 73, 72, 124/71, 69, 56, 49, 77, 76, 75; D22/108, 100

(56) References Cited

U.S. PATENT DOCUMENTS

| | | | | | |
|---|---|---|---|---|---|
| 2,537,358 | A | * | 1/1951 | Lincoln | 124/58 |
| 4,890,597 | A | * | 1/1990 | Ekstrom | 124/74 |
| 5,494,024 | A | | 2/1996 | Scott | 124/73 |
| 5,505,188 | A | | 4/1996 | Williams | 124/74 |
| 5,515,838 | A | | 5/1996 | Anderson | 124/76 |
| 5,572,982 | A | | 11/1996 | Williams | 124/74 |
| 5,590,886 | A | | 1/1997 | Lush | 473/577 |
| 5,595,165 | A | | 1/1997 | Conte | 124/18 |
| 5,597,164 | A | | 1/1997 | Dodds | 273/371 |
| 5,613,483 | A | * | 3/1997 | Lukas et al. | 124/73 |
| 5,630,406 | A | | 5/1997 | Dumont | 124/56 |
| 5,669,369 | A | | 9/1997 | Scott | 124/73 |
| 5,673,679 | A | | 10/1997 | Walters | 124/53.5 |
| 5,676,548 | A | | 10/1997 | McAlpin et al. | 434/19 |
| 5,778,868 | A | | 7/1998 | Shepherd | 124/76 |
| 5,791,325 | A | | 8/1998 | Anderson | 124/56 |
| 5,845,593 | A | | 12/1998 | Birkestrand | 114/39.001 |
| 5,850,826 | A | | 12/1998 | Guthrie | 124/62 |
| 5,896,850 | A | | 4/1999 | Sullivan, Jr. | 124/74 |
| 5,927,261 | A | * | 7/1999 | Bofill | 124/80 |
| 5,931,342 | A | | 8/1999 | Taylor | 222/5 |
| 5,947,100 | A | | 9/1999 | Anderson | 124/45 |
| 5,950,611 | A | * | 9/1999 | Lopez et al. | 124/72 |
| 5,967,916 | A | | 10/1999 | Robeson | 473/600 |
| 5,988,153 | A | | 11/1999 | Yoshimura | 124/81 |
| 5,993,215 | A | | 11/1999 | Kotsiopoulos et al. | 434/21 |
| 6,003,504 | A | | 12/1999 | Rice et al. | 124/73 |
| 6,003,547 | A | | 12/1999 | Tippmann, Jr. | 137/588 |
| 6,062,208 | A | | 5/2000 | Seefeldt et al. | 124/71 |
| 6,109,252 | A | | 8/2000 | Stevens | 124/51.1 |
| 6,138,656 | A | | 10/2000 | Rice et al. | 124/73 |
| 6,142,136 | A | | 11/2000 | Velasco | 124/71 |
| 6,142,137 | A | | 11/2000 | MacLaughlin | 124/72 |
| 6,193,410 | B1 | | 2/2001 | Puckett, II | 366/348 |
| 6,199,286 | B1 | | 3/2001 | Reed, Jr. et al. | 33/265 |
| 6,199,311 | B1 | | 3/2001 | Foster | 43/1 |
| 6,213,112 | B1 | | 4/2001 | Squire | 124/74 |
| 6,223,658 | B1 | | 5/2001 | Rosa et al. | 102/501 |
| 6,226,915 | B1 | | 5/2001 | Kotsiopoulos | 42/71.02 |
| 6,233,928 | B1 | | 5/2001 | Scott | 60/407 |
| 6,242,489 | B1 | | 6/2001 | Pinney | 514/562 |
| 6,273,080 | B1 | | 8/2001 | Sullivan, Jr. | 124/84 |

(List continued on next page.)

FOREIGN PATENT DOCUMENTS

EP 909936 A2 * 4/1999 ..... F41B/11/06

*Primary Examiner*—Charles T. Jordan
*Assistant Examiner*—John W Zerr
(74) *Attorney, Agent, or Firm*—Robert W. Strozier

(57) ABSTRACT

A paint ball gun is disclosed including a forward mounted gas supply system. The gas supply systems includes a straight or bent direct connection between the low pressure portion of the paintball gun and the gas cylinder and includes a gas cylinder securing and support assembly. The bent direct connections attach to the gas cylinder and the securing and support assembly is attached to the gun handle and can also include a socket surrounding a major portion of the cylinder. In the straight configurations, the securing and support assembly includes the socket and optionally a support arm attached at the gun handle.

24 Claims, 8 Drawing Sheets

U.S. PATENT DOCUMENTS

| | | | | |
|---|---|---|---|---|
| 6,276,354 | B1 | 8/2001 | Dillon | 124/74 |
| 6,280,080 | B1 | 8/2001 | Puckett, II | 366/348 |
| 6,305,941 | B1 | 10/2001 | Kotsiopoulos et al. | 434/11 |
| 6,306,913 | B1 | 10/2001 | Hayes et al. | 514/689 |
| 6,352,032 | B1 | 3/2002 | Pinney | 102/367 |
| 6,367,465 | B1 | 4/2002 | Buccieri, Jr. | 124/31 |
| 6,371,099 | B1 | 4/2002 | Lee | 124/66 |
| 6,378,367 | B1 | 4/2002 | Dilz, Jr. | 73/488 |
| 6,386,113 | B1 | 5/2002 | Pinney | 102/367 |
| 6,409,150 | B2 * | 6/2002 | Sullivan et al. | 251/360 |
| 6,532,949 | B1 * | 3/2003 | McKendrick | 124/77 |
| 6,546,950 | B1 * | 4/2003 | Juan | 137/270 |
| 2002/0059928 | A1 * | 5/2002 | Ferrara et al. | 124/49 |
| 2003/0101979 | A1 * | 6/2003 | Schavone | 124/74 |
| 2003/0127085 | A1 * | 7/2003 | Brunette et al. | 124/74 |

* cited by examiner

PAINT BALL GUN HAVING A FRONT MOUNTED GAS CYLINDER

BACKGROUND OF THE INVENTION

1. Field of the Invention

The present invention relates to a paint ball gun apparatus having a front mounted gas cylinder that allows a user to position the gun closer to the user's eye for superior aiming and control.

More particularly, the present invention relates to a paint ball gun apparatus including a barrel assembly, a paint ball firing/trigger assembly, a paint ball feed assembly, and a gas supply assembly, where the gas supply assembly includes an expansion chamber positioned in from of the trigger assembly and connected to a front mounted a gas cylinder, where the front mounting allows a user to position the gun closer to his/her body for improved handling, control, aiming and firing. The gas supply assembly can also include a gas transfer member interposed between the expansion chamber and the cylinder and a cylinder holding assembly connected to a bottom of the trigger grip assembly to support the front mounted gas cylinder. The present invention also relates to methods for making and using same.

2. Description of the Related Art

Numerous types of paint ball guns have been developed and used in a variety of manners, such as in simulated war games. These paint ball guns are generally powered by $CO_2$ cartridges or cylinders which, generally, propel the paint balls at a specified velocity, such as three hundred (300) feet per second out of the gun barrel. In general, the prior art paint ball guns include a typical firearm type mechanism including a bolt, spring and cocking handle. The prior art paint ball guns have the gas cylinder mounted behind the handle interfering with the user's ability to get the gun close to his/her body for accurate aiming and more controlled firing. Examples of prior art paint guns can be found in the U.S. Pat. Nos. 6,386,113, 6,378,367, 6,371,099, 6,367,465, 6,352,032, 6,305,941, 6,280,080, 6,276,354, 6,273,080, 6,233,928, 6,226,915, 6,223,658, 6,213,112, 6,199,286, 6,142,137, 6,142,136, 6,138,656, 6,109,252, 6,062,208, 6,003,547, 6,003,504, 5,993,215, 5,988,153, 5,967,916, 5,947,100, 5,931,342, 5,927,261, 5,896,850, 5,850,826, 5,791,325, 5,778,868, 5,676,548, 5,673,679, 5,669,369, 5,630,406, 5,599,187, 5,597,164, 5,595,165, 5,590,886, 5,572,982, 5,515,838, 5,505,188, 5,494,024, incorporated herein by reference.

Thus, there is a need in the art for an improved paint ball gun having a front disposed gas cylinder which allows the user to hold the gun closer to the user's body for better aiming and more controlled firing.

SUMMARY OF THE INVENTION

The present invention provides a paint ball gun including a front disposed gas cylinder.

The present invention also provides a paint ball gun apparatus including a barrel assembly, a paint ball firing/trigger assembly, a paint ball feed assembly, and a gas supply assembly having a forward mounted gas cylinder.

The present invention also provides a paint ball gun apparatus including a barrel assembly, a paint ball firing/trigger assembly, a paint ball feed assembly, and a gas supply assembly having an expansion chamber including a connector designed to detachably receive a gas cylinder, where the cylinder depending vertically downward from the connector.

The present invention also provides a paint ball gun apparatus including a barrel assembly, a paint ball firing/trigger assembly, a paint ball feed assembly, and a gas supply assembly having an expansion chamber, a forward mounted gas cylinder, a transfer connector interposed between the chamber and the cylinder and a support member attached to the trigger assembly for supporting the cylinder.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
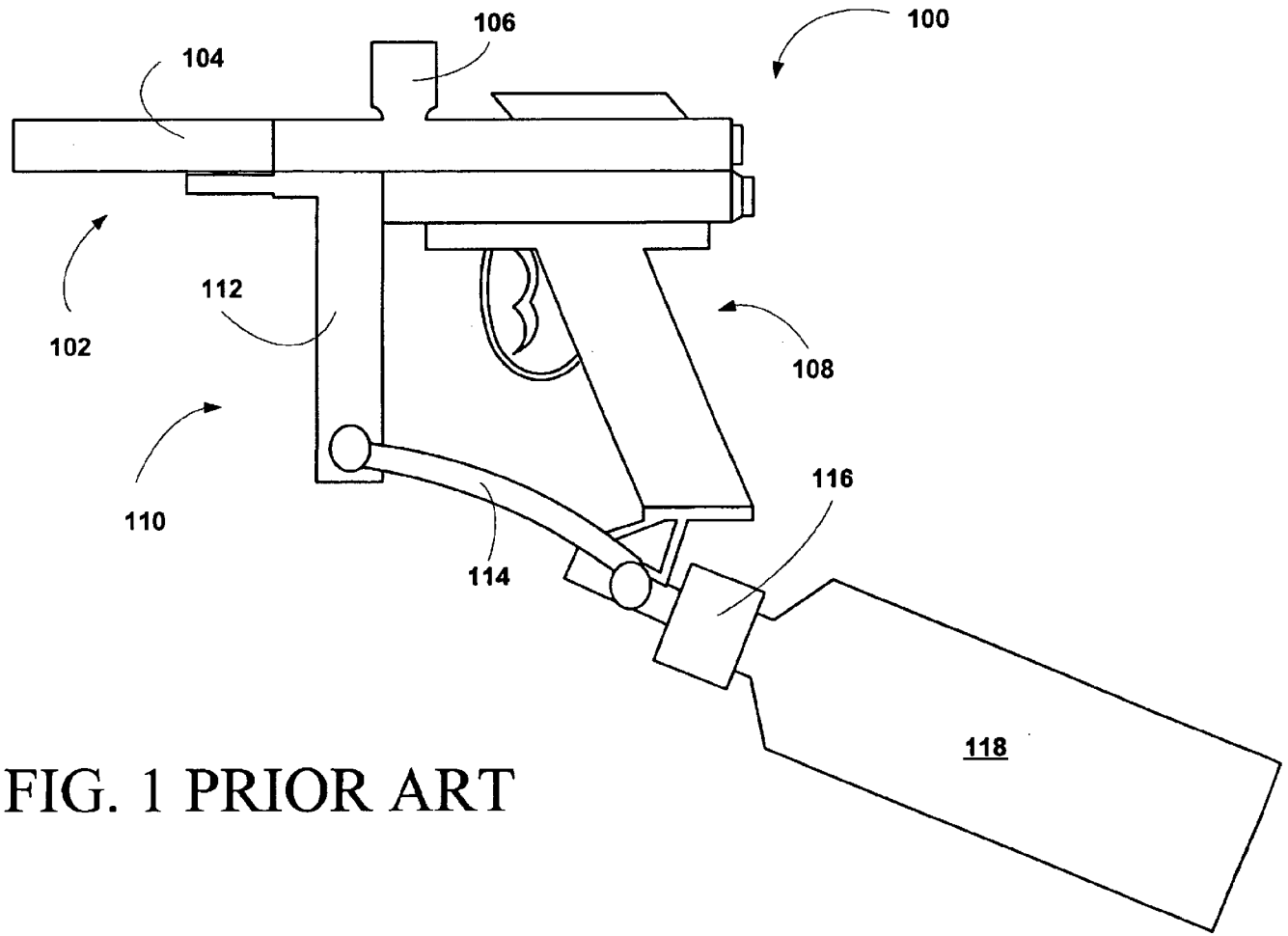
FIG. 1 PRIOR ART
FIG. 1 depicts a prior art paint ball gun having a traditional gas supply assembly, where a gas cylinder is mounted at a rear of the gun.

The inventor has found that a paint ball gun can be constructed with a front mounted gas cylinder and gas cylinder connection assembly that allows a user the ability to hold the gun closer to his/her body for improved handling, aiming, firing and maneuvering. The inventor has also found that the gun can include a combined hopper/feeder as disclosed in U.S. patent application Ser. No. 10/187,386 filed Jul. 1, 2002, incorporated herein by reference. The invention also found that the gun can include locking connections between the feed tube on the gun and the hopper or hopper feeder or optionally between the feed tube, a hollow connector and the hopper or hopper/feeder as disclosed in U.S. patent application Ser. No. 10/117,673 filed Apr. 5, 2002, incorporated herein by reference.

The present invention broadly relates to a paint ball gun including a front mounted gas cylinder and gas transfer assembly. The gun includes a barrel assembly, a handle/trigger assembly, a paint ball feed assembly, and a gas delivery system, where the gas delivery system includes an expansion chamber extending downward from the barrel assembly and a connector for receiving a gas cylinder. The gas delivery system can also include an elbow-shaped transfer member interposed between the expansion chamber and the gas cylinder. The gas delivery system can also include a securing assembly connected to a bottom of the handle assembly and designed to support and secure the gas cylinder to the gun.

The paint ball guns of this invention can also include a dispenser having a first locking connector, a closed end and an opened end, where the open end includes a detachable cover. The gun also includes a connecting member having a second locking connector, where the two locking end are designed to lockingly secure the dispenser to the connecting member with sufficient locking force to decrease or eliminate the dispenser falling off of the gun during training exercises or games. The paint ball guns of this invention can also security tighteners for further securing the hopper to the gun feed tube with or without the connecting member. The paint ball guns of this invention can also include a combined hopper/feeder including an outer shell, an interior designed to hold paint balls, a first aperture having a lip for filling the hopper/feeder apparatus with paint balls, a second aperture having a paint ball dispensing tube depending from a center portion of the apparatus and a retractable closing assembly located at an upper portion of the dispensing tube for preventing paint balls from entering the depending tube until the closing assembly is retracted.

Suitable materials out of which the dispenser can be constructed include, without limitations, metals, plastics, composites, ceramics, or the like, or mixtures or combinations thereof. Preferably, the dispenser is constructed out of plastics or composites or mixtures or combinations thereof. Suitable metals include, without limitation, aluminum and its alloys such as aluminum-magnesium alloys or the like, titanium, steel or other iron alloys, copper and its alloys such as bronze, brass or the like, or any other metal or its alloys and mixture or combinations thereof. Suitable plastics include, without limitation, polyolefins such as polyethylene, polypropylene, polybutylene, polyhexylene, polystyrene, polyalphamethylstyrene, or the like or copolymers thereof, acrylics, urethanes, polyesters, thermoplastics, thermal setting resins, thermoplastic elastomers, liquid crystal polymers, polyalkyleneoxides, or any other structural plastic suitable for making a durable paint ball dispenser. Suitable composites includes, without limitation, polymer matrices selected from the plastics listed above reinforced by a fiber such as carbon fibers, polyamides such as Kevlar, boron-nitride fibers, glass fibers, or the like or mixture or combination thereof.

Suitable material out of which the dispenser covers can be made include, without limitation, elastomers such as natural or synthetic rubbers or the like, urethanes rubbers, silicon rubbers or any other resilient and shock absorbing materials or mixtures or combinations thereof.

Suitable locking connections include, without limitations, threaded connections comprising a male threaded connector and a female threaded connector, clip rings, cotter pins, snap fittings including a lip and an groove, quick disconnects such as used in water holes, or any other locking connection assembly or combinations thereof.

Referring now to FIG. 1, a prior art paint ball gun assembly, generally 1, is shown to include a barrel assembly 3 having a barrel 5 and a hollow, paint ball feeding tube 7 extending upward from the barrel 104. The gun 100 also includes a handle/trigger assembly 9 and a gas delivery system 11. The gas deliver system 110 includes an expansion chamber 13, a gas transfer line 15, a gas cylinder connector 17 and a gas cylinder 19. As can be seen, the gas cylinder 118 is rear mounted and in this configuration tends to interfere with handling, maneuvering, aiming and firing the gun.

Figure 2A:
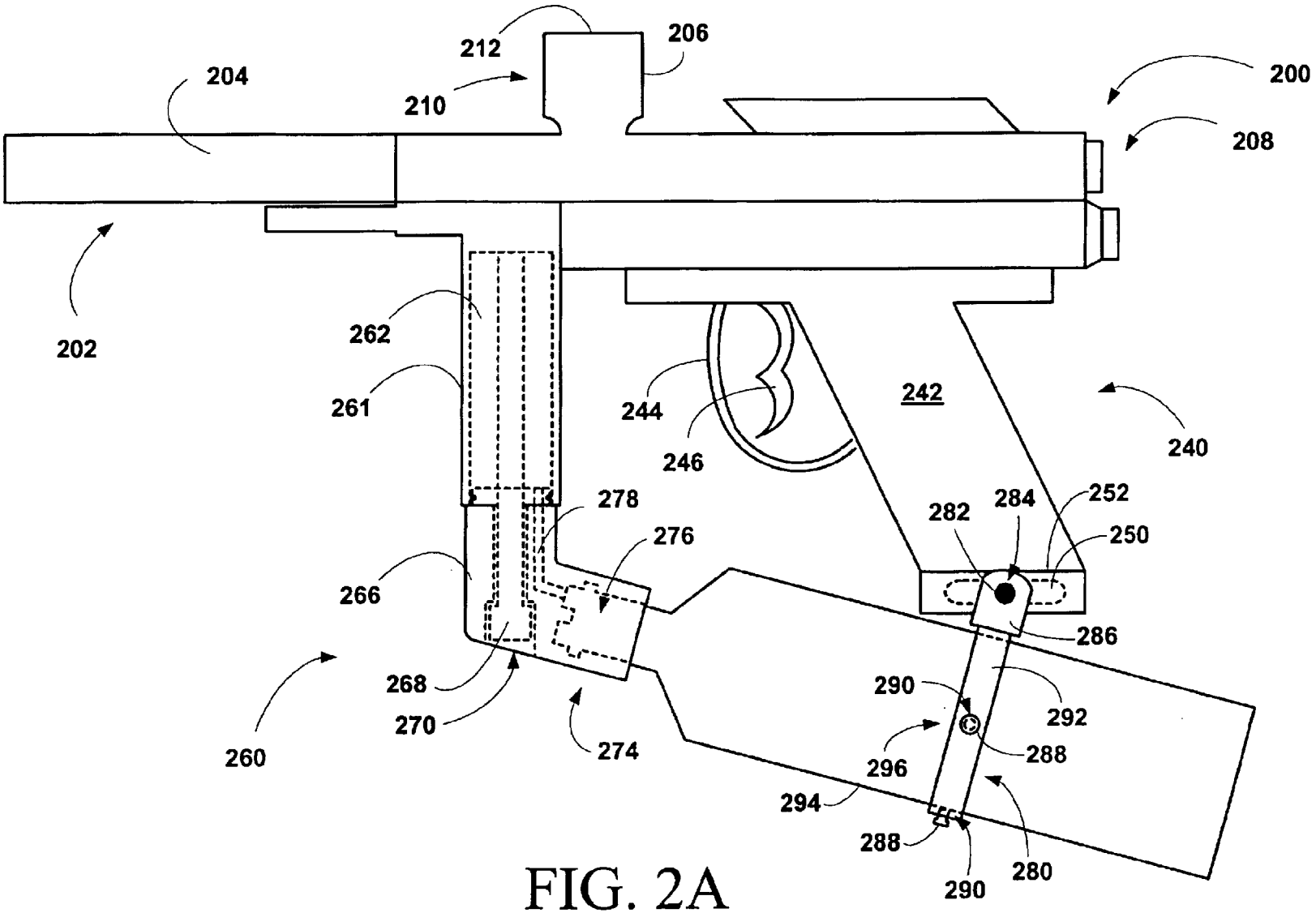
FIG. 2A depicts a preferred embodiment of a paint ball gun having a front mounted gas cylinder.
Figure 2B:
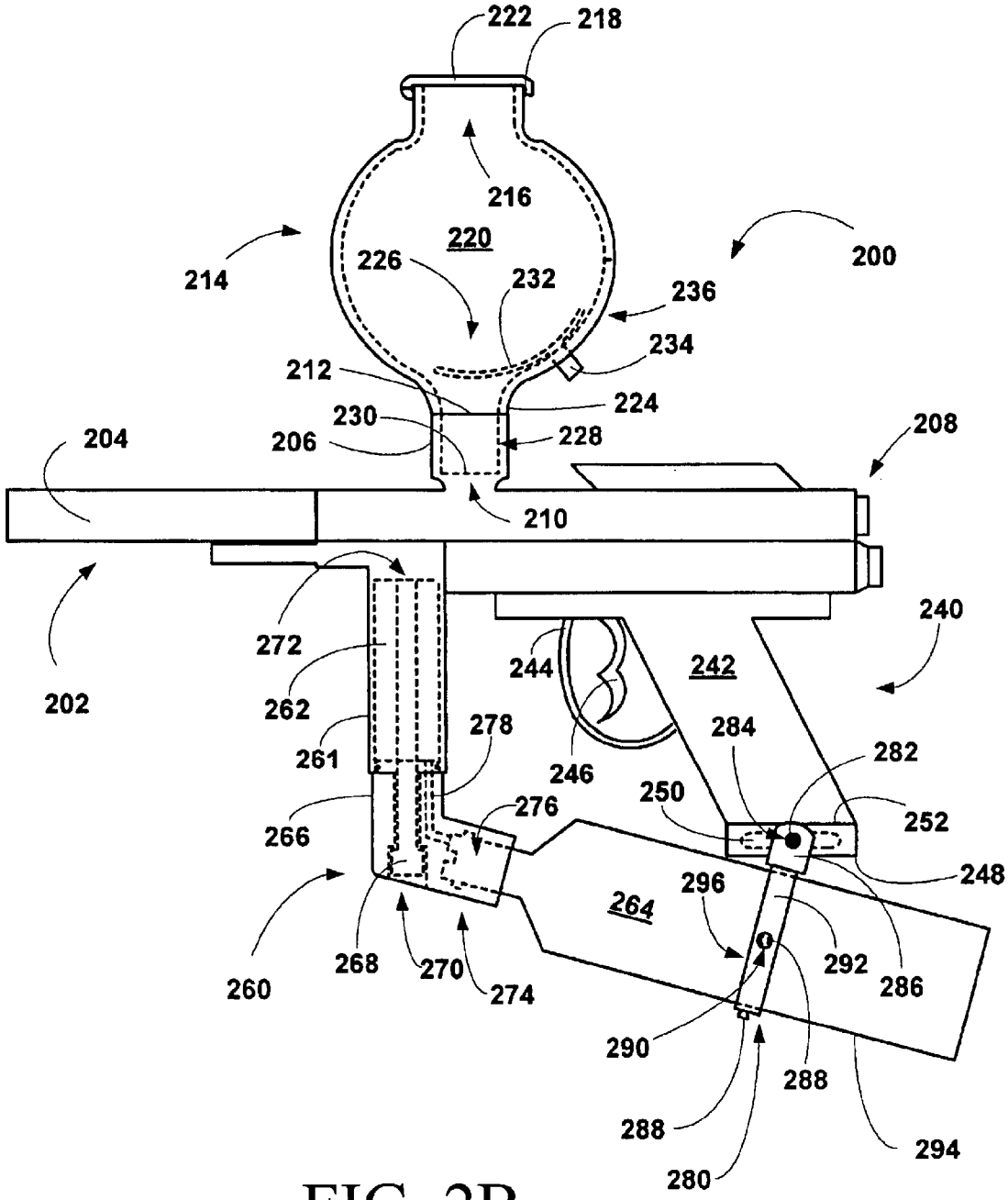
FIG. 2B depicts the gun of FIG. 2A having a reservoir attached thereto.

Referring now to FIGS. 2A&B, a preferred embodiment of a paint ball gun of this invention, generally 200, is shown to include a barrel assembly 202, a handle/trigger assembly 240, and a gas delivery assembly 260. The barrel assembly 202 includes a barrel 204 and a hollow, paint ball feed tube 206 extending upward from the barrel 204 towards its handle end 208. The feed tube 206 includes a female connector 210 at its distal end 212. As shown in FIG. 2B, the gun 200 also includes a paint ball dispenser 214, where the dispenser 214 includes an open top 216 having a lip 218, a paint ball reservoir 220, a cover 222 designed to engage the lip 218 so that the top 216 can be closed after the dispenser 214 is filled with paint balls (not shown), and a paint ball dispensing neck 224 depending from a lower central region 226 of the dispenser 214 and having a male connector 228 at this distal end 230 adapted to engage the female connector 210 of the feed tube 206. The dispenser 214 further includes a slidable paint ball stop 232 shown in its closed state, which is designed to prevent paint balls from entering the neck 224 until the stop is moved using its nob 234 to its open state in a slot 236. The reservoir 220 of the dispenser 214 is substantially spherical in geometry.

The handle/trigger assembly 240 includes a grip 242, a trigger guard 244 and a trigger 246. The handle/trigger assembly 240 also includes a support member 248 having a slot 250 attached to a bottom end 252 of the grip 242. The gas delivery assembly 260 includes an expansion chamber 262 (an outside 261 of which functions as a secondary grip), a gas cylinder 264 and an elbow shaped gas transfer member 266 interposed therebetween. The transfer member 266 is attached to the gun barrel assembly 202 by bolt 268 which extends from an aperture 270 extending up through the transfer member 266 and engaging the barrel 204 at a position 272. The transfer member 266 also includes a gas cylinder connector 274 adapted to engage a top 276 of the gas cylinder 264 and a gas transfer conduit 278 adapted to deliver gas in the gas cylinder 264 to the expansion chamber 262 for ultimate use in firing paint balls out of the barrel 204. Alternately stated, the conduit 278 places the gas cylinder 264 in fluid communication with the expansion chamber 262, where fluid communication means that gas can flow from the cylinder 264 to the chamber 262 when the top 276 of the cylinder 264 is inserted into the connector 274. The gas delivery system 260 also includes a brace 280 pivotally mounted in the slot 250 of the support member 248 of the handle/trigger assembly 240. The brace 280 is mounted in the slot 250 by a bolt 282 passing through an aperture 284 in a brace mount 286 to engage a nut (not shown) on the other side of the brace mount 286. The brace mount 286 can pivot and slide in the slot 250 so that the brace can be conformed to the angle of the gas cylinder 264 before being tightened into place by the nut. The brace 280 also includes three threaded nobs 288 (two of which are shown) that thread through threaded apertures 290 in a strap portion 292 of the brace 280. The nobs 288 are designed to engage an outer wall 294 of the gas cylinder 264 at three points 296 (only one of which is shown). The brace 280 and the nobs 288 are designed to secure the gas cylinder 264 in place during use and to decrease stress on the transfer member 266 and the expansion chamber 262. Without the brace and nobs and because of the forward disposition of the cylinder, the gas cylinder could be subject to considerable impact forces that could result in dislodgment of the gas cylinder, damage to the cylinder, damage to the transfer member, damage to the expansion chamber or any combination of these adverse affects.

Figure 3A:
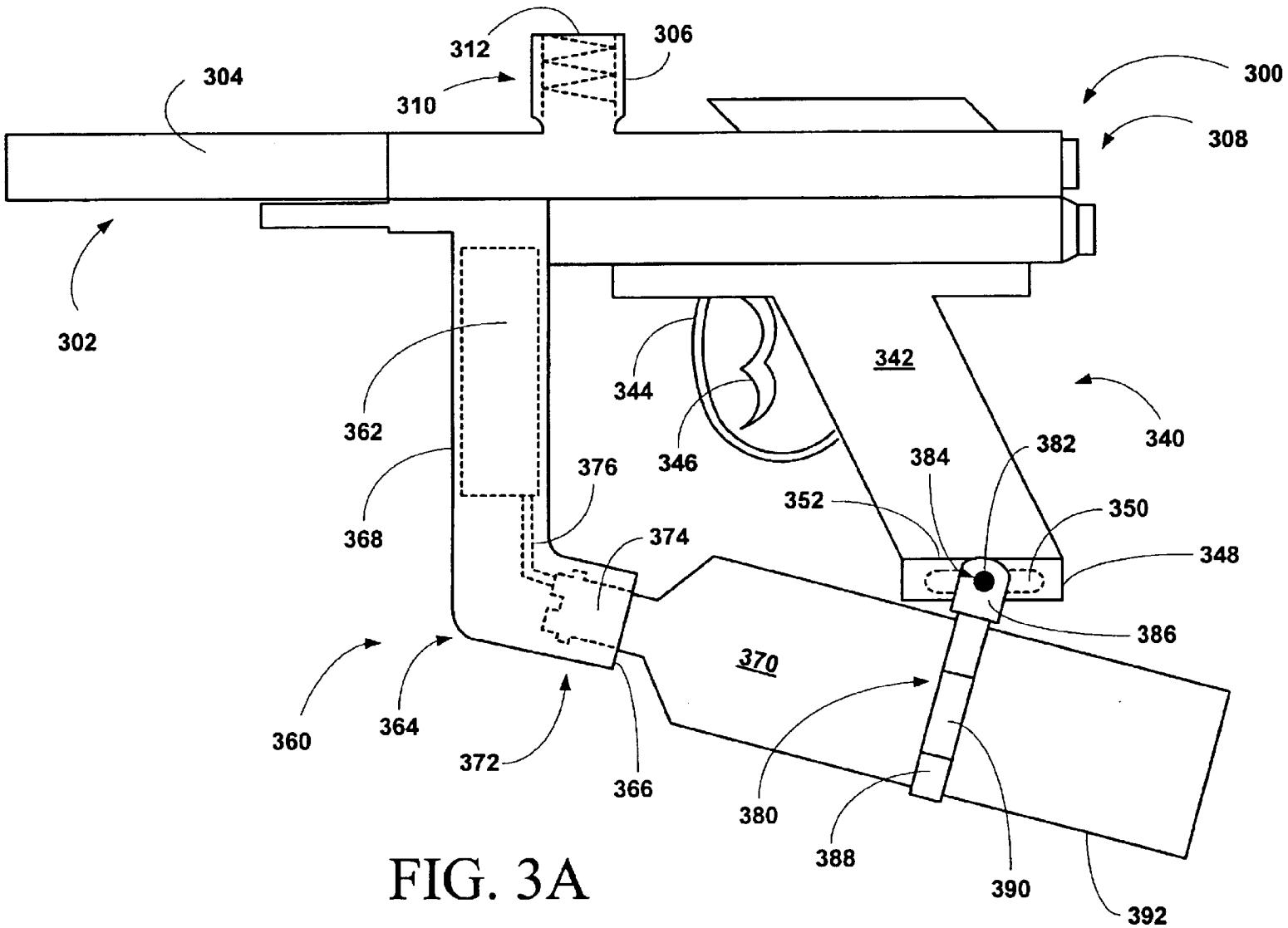
FIG. 3A depicts another preferred embodiment of a paint ball gun having a front mounted gas cylinder.
Figure 3B:
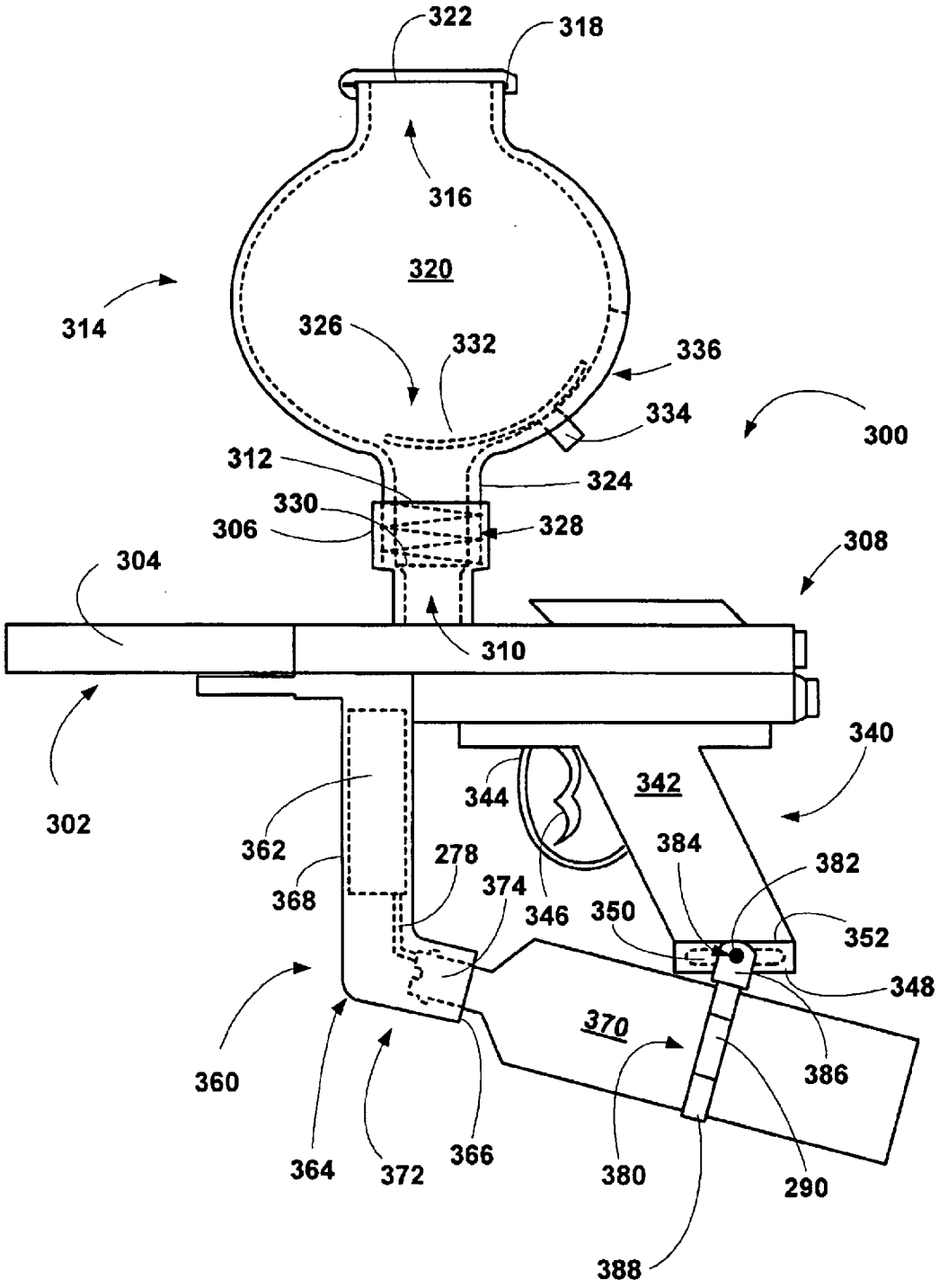
FIG. 3B depicts the gun of FIG. 3A having a reservoir attached thereto.

Although the brace of FIGS. 2A–B is shown to have a rigid strap with nobs designed to engage the gas cylinder at three places, the brace can be a flexible strap with a traditional belt like fastener or the brace can be a flexible strap having a hook and loop fabric fastener as shown in FIGS. 3A–B. Of course, any other type of brace can be used as well provided that the brace supports and secures the forward mounted gas cylinder to the gun.

Referring now to FIGS. 2A–B, another preferred embodiment of a paint ball gun of this invention, generally 300, is shown to include a barrel assembly 302, a handle/trigger assembly 340, and a gas delivery assembly 360. The barrel assembly 302 includes a barrel 304 and a hollow, paint ball feed tube 306 extending upward from the barrel 304 towards its handle end 308. The feed tube 306 includes a threaded female connector 310 at its distal end 312. As shown in FIG. 2B, the gun 300 also includes a paint ball dispenser 314, where the dispenser 314 includes an open top 316 having a lip 318, a paint ball reservoir 320, a cover 322 designed to engage the lip 318 so that the top 316 can be closed after the dispenser 314 is filled with paint balls (not shown), and a paint ball dispensing neck 324 depending from a lower central region 326 of the dispenser 314 and having a threaded male connector 328 at this distal end 330 adapted to detachably and lockingly engage the female connector 310 of the feed tube 306. The dispenser 314 further includes a slidable paint ball stop 332 shown in its closed state, which is designed to prevent paint balls from entering the neck 324 until the stop is moved using its knob 334 to its open state in a slot 336. The reservoir 320 of the dispenser 314 is substantially spherical in geometry.

The handle/trigger assembly 340 includes a grip 342, a trigger guard 344 and a trigger 346. The handle/trigger assembly 340 also includes a support member 348 having a slot 350 attached to a bottom end 352 of the grip 342. The gas delivery assembly 360 includes an expansion chamber 362 having an elbow bend 364 near its distal end 366 (an outside 368 of which functions as a secondary grip) and a gas cylinder 370. The distal end 366 includes a gas cylinder connector 372 adapted to engage a top 374 of the gas cylinder 370 and a gas transfer conduit 376 adapted to deliver the gas in the gas cylinder 370 to the expansion chamber 362 for ultimate use in firing paint balls out of the barrel 304. The gas delivery system 360 also includes a brace 380 pivotally mounted in the slot 350 of the support member 348 of the handle/trigger assembly 340. The brace 380 is mounted in the slot 350 by a bolt 382 passing through an aperture 384 in a brace mount 386 to engage a nut (not shown) on the other side of the brace mount 386. The brace mount 386 can pivot and slide in the slot 350 so that the brace can be conformed to the angle of the gas cylinder 370 before being tightened into place by the nut. The brace 380 includes a strap portion 388 having a hook and loop fastener 390, where the strap portion 388 is designed to fit around and engage an outer wall 392 of the gas cylinder 370 and the fastener 390 secures the strap 388 in place. The brace 380 is designed to secure the gas cylinder 370 in place during use and to decrease stress on the expansion chamber 362. Without the brace and because of the forward disposition of the cylinder, the gas cylinder could be subject to considerable impact forces that could result in dislodgment of the gas cylinder, damage to the cylinder, damage to the expansion chamber or any combination of these adverse affects.

Figure 3C:
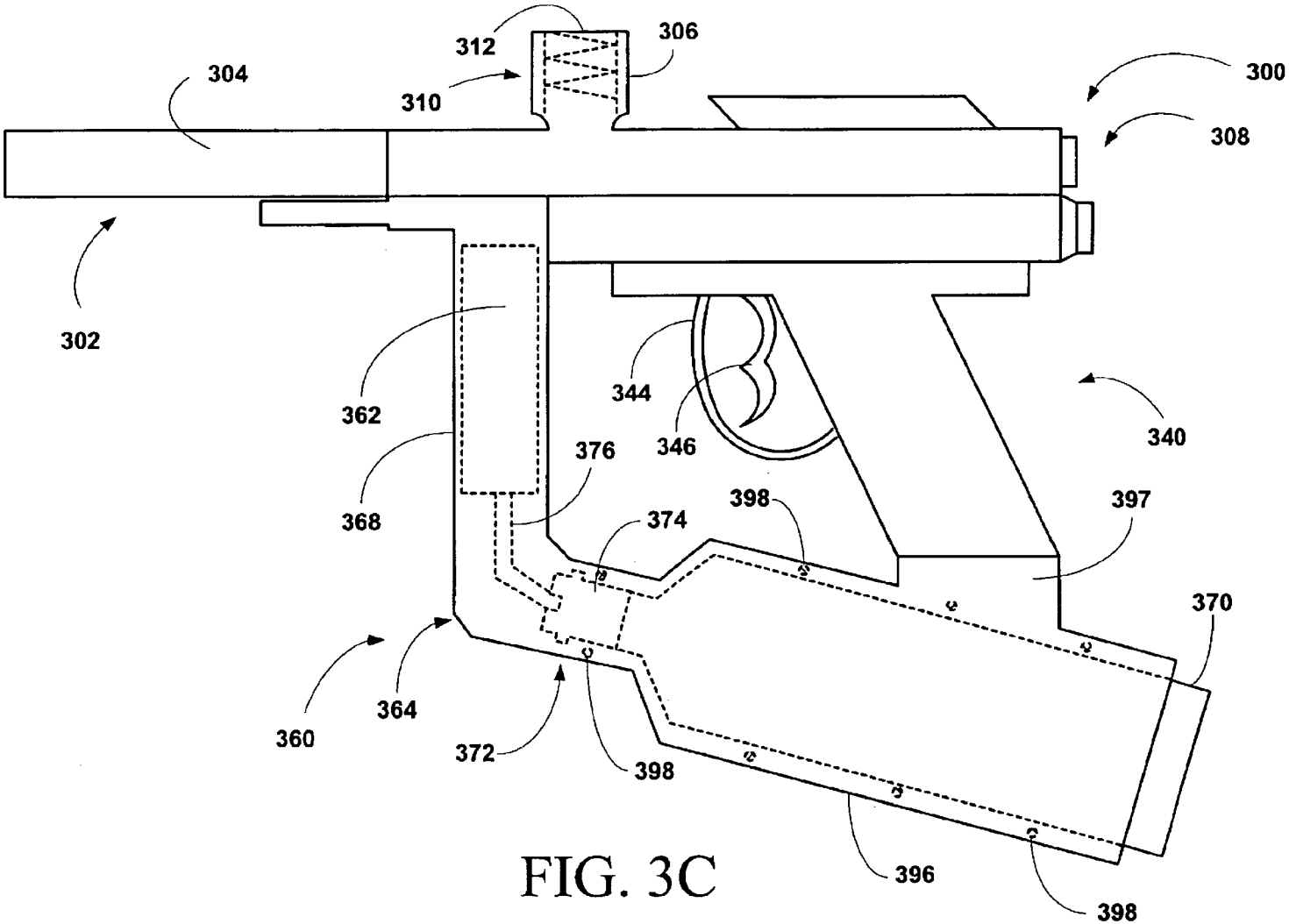
FIG. 3C depicts an alternate construction of the gun of FIG. 3A.

Looking now to FIG. 3C, an alternate gun 300 construction is shown to include an integrated expansion chamber housing and attached gas cylinder holder 394 having a cylinder socket 396 adapted to receive, hold, secure and protect the gas cylinder 370, which is attached to or integral with the bottom end 352 of the grip 342 via tab 397. The socket 396 can include rubber bumpers or O-rings 398 to further hold and secure the gas cylinder 370 within the socket 396. The integrated expansion chamber and holder 394 also includes the cylinder connector 372 and the gas conduit 376.

Figure 4A:
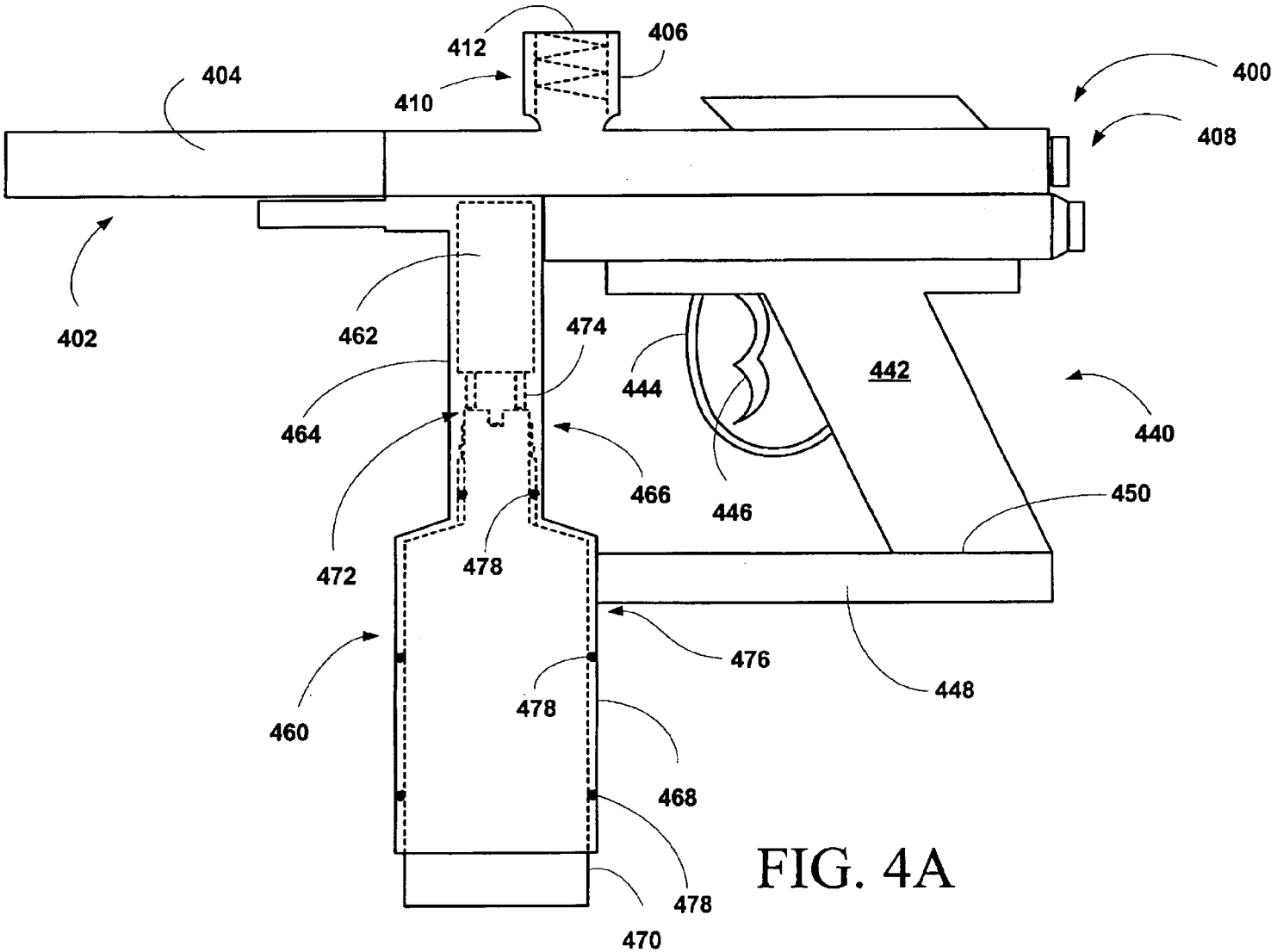
FIG. 4A depicts another preferred embodiment of a paint ball gun having a front mounted gas cylinder.
Figure 4B:
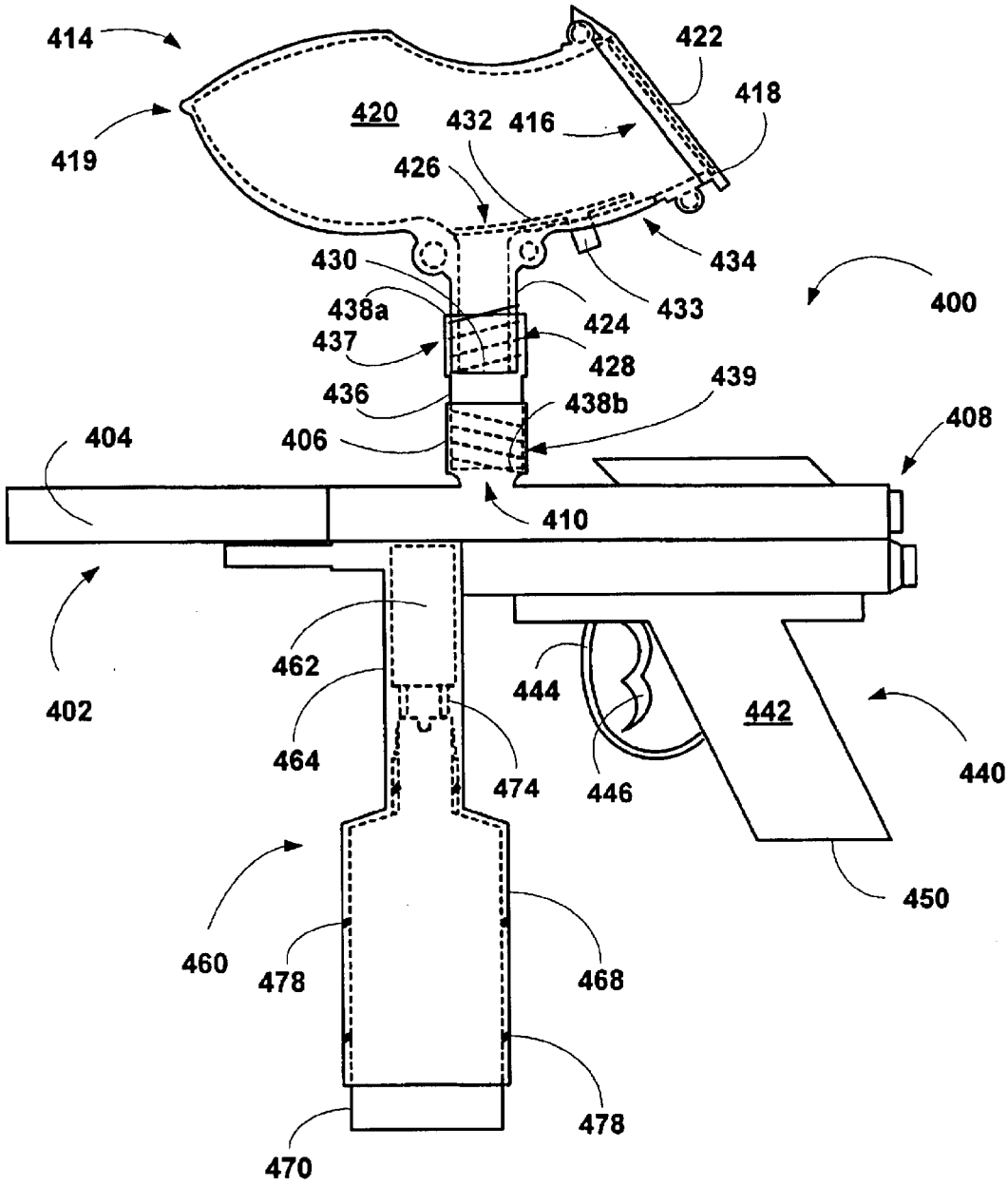
FIG. 4B depicts the gun of FIG. 4A having a reservoir attached thereto.

Referring now to FIGS. 3A–B, another preferred embodiment of a paint ball gun of this invention, generally 400, is shown to include a barrel assembly 402, a handle/trigger assembly 440, and a gas delivery assembly 460. The barrel assembly 402 includes a barrel 404 and a hollow, paint ball feed tube 406 extending upward from the barrel 404 towards its handle end 408. The feed tube 406 includes a female connector 410 at its distal end 412. As shown in FIG. 3B, the gun 400 also includes a paint ball dispenser 414, where the dispenser 414 includes an open side 416 having a lip 418, a closed side 419, a paint ball reservoir 420, a cover 422 designed to engage the lip 418 so that the open side 416 can be closed after the dispenser 414 is filled with paint balls (not shown), and a paint ball dispensing neck 424 depending from a lower central region 426 of the dispenser 414, where the neck 424 includes a male connector 428 at this distal end 430 adapted to engage the female connector 410 of the feed tube 406. The dispenser 414 further includes a slidable paint ball stop 432 shown in its closed state, which is designed to prevent paint balls from entering the neck 424 until the stop is moved using its knob 433 through a slot 434 to its open state. The dispenser 414 of FIGS. 4A–B is banana-shaped. The gun 400 also includes a connecting member 436 interposed between the feed tube 406 and the dispenser neck 424 having a threaded female connector 437 associated with its first end 438a and a male connector 439 associate with its second end 438*b*. The female connector 437 is designed to detachably and lockingly engage the male connector 428 of the dispenser 414, while the male connector 439 is designed to detachably and lockingly engage the female connector 410 of the feed tube 406.

The handle/trigger assembly 440 includes a grip 442, a trigger guard 444 and a trigger 446. The handle/trigger assembly 440 can optionally include a support member 448 attached to a bottom end 450 of the grip 442. The gas delivery assembly 460 includes an expansion chamber 462 (an outside 464 of which functions as a secondary grip), a gas cylinder connector 466, a gas cylinder socket 468 and a gas cylinder 470. The connector 466 is adapted to engage a top 472 of the gas cylinder 470 and includes a gas transfer conduit 474 adapted to deliver the gas in the gas cylinder 470 to the expansion chamber 462 for ultimate use in firing paint balls out of the barrel 404, when a user pulls the trigger 446. The socket 468 extends vertically downward from the expansion chamber 462, but can be angle toward the handle assembly is desired. The optional support member 448 is adapted to detachably or permanently attach to an upper portion 476 of the socket 468 to add additional structural support to the socket 448 as needed or desired. Again, the socket 468 can include rubber bumpers or O-rings 478 to further hold and secure the gas cylinder 470 within the socket 468.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

I claim:

1. A paint ball gun comprising a front mounted, gas delivery system, where the gas delivery system comprises a gas cylinder, a gas cylinder securing and support assembly and an expansion chamber extending downward from a front gun position and including a connector at a distal end having a gas conduit, where the connector is adapted to receive the gas cylinder and the gas conduit allows gas to flow from the cylinder to the chamber, where the securing and supporting assembly is designed to support and secure the gas cylinder to the gun at an angle so that the gas cylinder is angled towards a back of the gun and where the forward mounted gas delivery system improves gun handling, maneuvering, aiming and firing.

2. The gun of claim 1, further comprising a barrel assembly, a paint ball supply assembly and a handle/trigger assembly.

3. The gun of claim 2, wherein the barrel assembly includes a feed tube having a first connector and the paint ball supply assembly includes a paint ball dispenser having a second connector, where the two connectors are designed to detachably engage each other.

4. The gun of claim 3, wherein the connectors are threaded connectors and are designed to detachably and lockingly engage each other.

5. The gun of claim 1, wherein the securing and support assembly depends from a bottom of a grip of a handle/trigger assembly.

6. The gun of claim 2, further comprising an elbow-shaped transfer member interposed between the expansion chamber and the gas cylinder, where a distal end of the chamber includes a connector designed to receive a first end of the transfer member and a second end of the transfer member comprises the cylinder connector and where the transfer member further includes the conduit and where the elbow-shaped transfer member positions the gas cylinder at the angle.

7. The gun of claim 2, wherein the gas securing and support assembly comprises a gas cylinder socket designed to receive and surround a majority of the gas cylinder.

8. The gun of claim 7, wherein the socket includes an elbow bent section and includes a tab attached to a bottom of a grip of a handle/trigger assembly.

9. A paint ball gun comprising a barrel assembly, a handle/trigger assembly, a paint ball feed assembly, and a forward mounted, gas delivery system, where the gas delivery system includes an expansion chamber extending downward from the barrel assembly, a connector at a distal end of the chamber, a gas conduit, a gas cylinder and a gas cylinder securing and support member, where the connector is adapted to receive the gas cylinder and the gas conduit allows gas to flow from the cylinder to the chamber, where the securing and supporting assembly is designed to support and secure the gas cylinder to the gun at an angle so that the gas cylinder is angled towards a back of the gun and where the forward mounted gas delivery system improves gun handling, maneuvering, aiming and firing.

10. The gun of claim 9, wherein the the securing and support assembly comprises a gas cylinder socket designed to receive and surround a majority of the gas cylinder.

11. The gun of claim 10, wherein the barrel assembly includes a feed tube having a first connector and the paint ball supply assembly includes a paint ball dispenser having a second connector, where the two connectors are designed to detachably engage each other.

12. The gun of claim 11, wherein the connectors are threaded connectors and are designed to detachably and lockingly engage each other.

13. The gun of claim 9, wherein the support assembly depends from a bottom of a grip of a handle/trigger assembly.

14. The gun of claim 9, further comprising an elbow-shaped transfer member interposed between the expansion chamber and the gas cylinder, where a distal end of the chamber includes a connector designed to receive a first end of the transfer member and a second end of the transfer member comprises the cylinder connector and where the transfer member further includes the conduit and where the elbow-shaped transfer member positions the gas cylinder at the angle.

15. The gun of claim 10, wherein the socket includes an elbow bent section and includes a tab attached to a bottom of a grip of the handle/trigger assembly.

16. A paint ball gun comprising a barrel assembly, a handle/trigger assembly, a paint ball feed assembly, and a forward mounted, gas delivery system, where the gas delivery system includes an expansion chamber extending downward from the barrel assembly, a transfer connector at a distal end of the chamber, a gas cylinder and an elbow-shaped transfer member interposed between the expansion chamber and the gas cylinder having an expansion chamber connector, a gas cylinder connector and a gas conduit, where the transfer connector of the expansion chamber is adapted to receive the expansion chamber connector of the transfer member and the gas cylinder connector of the transfer member is adapted to receive the gas cylinder and the gas conduit places the gas cylinder into fluid communication with the expansion chamber so that gas can be delivered to the barrel assembly to propel paint balls therefrom when a trigger of the handle/trigger assembly is activated by a user and where the forward mounted gas delivery system improves gun handling, maneuvering, aiming and firing.

17. The gun of claim 16, further comprising a securing and support member depending from a handle of the gun adapted to secure and support the gas cylinder.

18. A paint ball gun comprising a front mounted, gas delivery system including a gas cylinder, an expansion chamber extending downward from a front gun position and including a first connector at a distal end, and an elbow-shaped transfer member interposed between the expansion chamber and the gas cylinder including a first end, a second end having a second connector and a gas conduit extending from the first end to the second end, where the first connector is designed to receive the first end of the transfer member and the second connector designed to receive the gas cylinder and where the gas conduit allows gas to flow from the cylinder to the chamber.

19. The gun of claim 18, further comprising a securing and support member depending from a handle of the gun adapted to secure and support the gas cylinder.

20. A paint ball gun comprising a front mounted, gas delivery system including a gas cylinder, an expansion chamber extending downward from a front gun position, and a gas cylinder securing and support member including a gas cylinder socket having a connector, where the socket is adapted to surround and protect a majority of the gas cylinder and the connector is adapted to place the gas cylinder into fluid communication with the chamber.

21. The gun of claim 20, wherein the socket extends vertically downward from the chamber.

22. The gun of claim 21, wherein securing and support member further includes a tab depending from a handle of the gun.

23. The gun of claim 20, wherein the socket extends at an angle toward a back of the gun.

24. The gun of claim 23, wherein securing and support member further includes a tab depending from a handle of the gun.

* * * * *